US008118413B2

(12) United States Patent
Hashimoto

(10) Patent No.: US 8,118,413 B2
(45) Date of Patent: Feb. 21, 2012

(54) LIQUID EJECTING HEAD, IMAGE FORMING APPARATUS, AND METHOD FOR MANUFACTURING LIQUID EJECTING HEAD

(75) Inventor: Kenichiroh Hashimoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 388 days.

(21) Appl. No.: 12/508,719

(22) Filed: Jul. 24, 2009

(65) Prior Publication Data

US 2010/0020130 A1 Jan. 28, 2010

(30) Foreign Application Priority Data

Jul. 25, 2008 (JP) ..... 2008-192205

(51) Int. Cl.
*B41J 2/045* (2006.01)

(52) U.S. Cl. ..... 347/70; 347/71

(58) Field of Classification Search ..... 347/15, 347/40, 43–47, 65–67, 68, 69, 70–71, 73, 347/77, 82
See application file for complete search history.

(56) References Cited

U.S. PATENT DOCUMENTS

| | | | | |
|---|---|---|---|---|
| 6,036,303 | A * | 3/2000 | Yamamoto et al. | 347/70 |
| 6,367,914 | B1 | 4/2002 | Ohtaka et al. | |
| 6,682,185 | B2 | 1/2004 | Hashimoto et al. | |
| 6,913,348 | B2 | 7/2005 | Hashimoto et al. | |
| 7,090,325 | B2 | 8/2006 | Hashimoto et al. | |
| 7,364,253 | B2 | 4/2008 | Hashimoto et al. | |
| 7,370,940 | B2 | 5/2008 | Hashimoto et al. | |
| 7,416,281 | B2 | 8/2008 | Nishimura et al. | |
| 2005/0231561 | A1 | 10/2005 | Hashimoto et al. | |
| 2006/0238579 | A1 | 10/2006 | Hashimoto et al. | |
| 2007/0229600 | A1 | 10/2007 | Hashimoto | |
| 2007/0247026 | A1 | 10/2007 | Tsukamura et al. | |
| 2007/0257968 | A1 | 11/2007 | Hashimoto et al. | |
| 2008/0309734 | A1 | 12/2008 | Nishimura et al. | |
| 2009/0102907 | A1 | 4/2009 | Yamanaka et al. | |

FOREIGN PATENT DOCUMENTS

| | | |
|---|---|---|
| JP | 2002-264346 | 9/2002 |
| JP | 3596586 | 9/2004 |
| JP | 2006-88400 | 4/2006 |

* cited by examiner

*Primary Examiner* — Thinh Nguyen
(74) *Attorney, Agent, or Firm* — Cooper & Dunham LLP

(57) ABSTRACT

A liquid ejecting head includes multiple nozzles to eject liquid droplet, a vibration unit including a vibration plate, the vibration plate forming at least one wall face of multiple liquid paths that communicate with the respective nozzles, a driving member to move the vibration plate, and the vibration unit formed of laminated multi-layered member that includes a resin layer to form the vibration plate, a first metal layer located on one side of the resin layer, and a second metal layer located on the other side of the resin layer, and wherein the first and second metal layers are formed of different metals, that is, the first metal layer has an ionization tendency higher than that of hydrogen, the second metal layer has an ionization tendency lower than that of hydrogen.

13 Claims, 7 Drawing Sheets

LIQUID EJECTING HEAD, IMAGE FORMING APPARATUS, AND METHOD FOR MANUFACTURING LIQUID EJECTING HEAD

CROSS-REFERENCE TO RELATED APPLICATIONS

This patent specification claims priority from Japanese Patent Application No. 2008-192205, filed on Jul. 25, 2008 in the Japan Patent Office, which is hereby incorporated by reference herein in its entirety.

BACKGROUND OF THE INVENTION

1. Field of the Invention

The present invention relates to an image forming apparatus, and more particularly, to an image forming apparatus that is equipped with a recording head for ejecting ink droplets.

2. Discussion of the Background

As an image forming apparatus, such as a printer, a facsimile machine, a plotter, or a multifunction machine including at least two of these functions, a liquid-ejecting image forming apparatus such as an inkjet recording device that uses a recording head for ejecting ink droplets is known. (It is to be noted that imaging, recording, and printing are synonymous with "image forming" in the descriptions below.)

There are two types of the liquid-ejecting image forming apparatus. A serial type image forming apparatus forms images using a recording head that ejects ink droplets while moving in a main scanning direction. A line type image forming apparatus forms images using a recording head that remains stationary while ejecting ink droplets. In either case, the liquid-ejecting image forming apparatus forms images by ejecting the ink droplets from the recording head onto a sheet of recording media while the sheet is being transported past the head. Therefore, transport characteristics of the image forming apparatus profoundly affect imaging performance.

Such a recording head, or liquid ejecting head, typically includes a compression chamber and an actuator for generating pressure to compress ink contained in the compression chamber, so that ink droplets are discharged from a nozzle connected to the compression chamber and onto the sheet.

As a pressure generating mechanism, the actuator itself may be of several types. There are known liquid ejecting heads that use a piezo-electric actuator composed of an appropriate piezo-electric element, a thermal actuator composed of a heating resistance member, and an electrostatic actuator that generates an electrostatic force. The actuator compresses individual liquid paths (hereinafter "compression chambers") to eject the ink.

Currently, there is market demand for an image forming apparatus capable of outputting high-quality images at high speed. To accommodate such demand, at present, the size of the individual liquid droplets is reduced and/or the nozzles are packed more densely together on the recording head to provide the required high resolution. At the same time, to increase the speed of image formation, a driving frequency with which the liquid is ejected is enhanced and a long liquid ejecting head, such as a line-type head that includes more nozzles per head unit, is used.

To increase the number of nozzles by using a long liquid ejecting head, compression liquid members that form complicated liquid paths are often formed not of silicon, which is difficult and costly to work into long pieces, but metal plates or resins.

In particular, in one known approach, a vibration plate and a liquid path plate are simultaneously formed as a single multi-layered element (laminated material), in which multiple metal plates are connected with a single resin plate in advance.

However, connecting the individual metal layers together using adhesive requires many connection processes and high connection accuracy, which increases production costs and is susceptible to plate misalignment. Further, in general, a multi-layered configuration that requires connecting stainless steel plate with another material is not preferable because stainless steel is not easily adhered to other materials.

There is an additional difficulty. In the above-described approach, two metal materials that can be etched and which are located on both sides of an etching-resistant member are simultaneously etched, and thus interior partition walls of the liquid chambers (liquid paths) and convex portions (e.g. a connection portion) connecting to the piezo-electronic element are simultaneously formed. At this time, because the amounts of etching of the metal members that can be etched are adjusted by using materials having different speeds of etching, the thickness of members that can be etched needs to be calculated based on the etching rate, respectively. Therefore, getting dimensions and shapes that have sufficient quality for a liquid ejecting head is difficult.

Further, as described above, when the vibration plate is formed with the laminated material that includes the multiple metal plates connected with the resin plate in advance, one metal plate serves as a portion that forms the partition wall of the liquid chambers (an interior partition wall through liquid path), and the other metal plate serves as a portion that forms a connection portion connected with a driving mechanism (e.g. a piezo-electronic element).

Then, when one metal plate forms thick (higher) partition wall of the liquid chambers, it is preferable that the thin connection portion be formed in a shorter time than the other metal plate is even if the accuracy is relatively lower, and that, even if it takes a relatively long time, the connection portion connecting to piezo-electronic element be formed at high accuracy.

SUMMARY OF THE INVENTION

In view of the foregoing, one illustrative embodiment of the present invention provides a liquid ejecting head including multiple nozzles to eject liquid droplet, a vibration unit including a vibration plate that forms at least one wall face of multiple liquid paths that communicate with the respective nozzles, and a driving member to move the vibration plate. The vibration unit is formed of a laminated multi-layered member that includes a resin layer to form the vibration plate, a first metal layer located on a first side of the resin layer, and a second metal layer located on a second side of the resin layer opposite the first side of the resin layer. The first and second metal layers are formed of different metals, with the first metal layer having an ionization tendency higher than that of hydrogen and the second metal layer has an ionization tendency lower than that of hydrogen.

In view of the foregoing, one illustrative embodiment of the present invention provides an image forming apparatus that includes a transport mechanism disposed facing the recording head and to transport a sheet, and the ink ejecting described above.

In view of the foregoing, one illustrative embodiment of the present invention provides a manufacturing method for a liquid ejecting head including the steps of: forming the vibration unit with a laminated multi-layered member including a resin layer to form the vibration plate, a first metal layer located on a first side of the resin layer, and a second metal layer located on a second side of the resin layer opposite the first side of the resin layer; etching the first metal layer and the second metal layer using different etching liquids; and forming predetermined patterns on the respective sides of the resin layer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
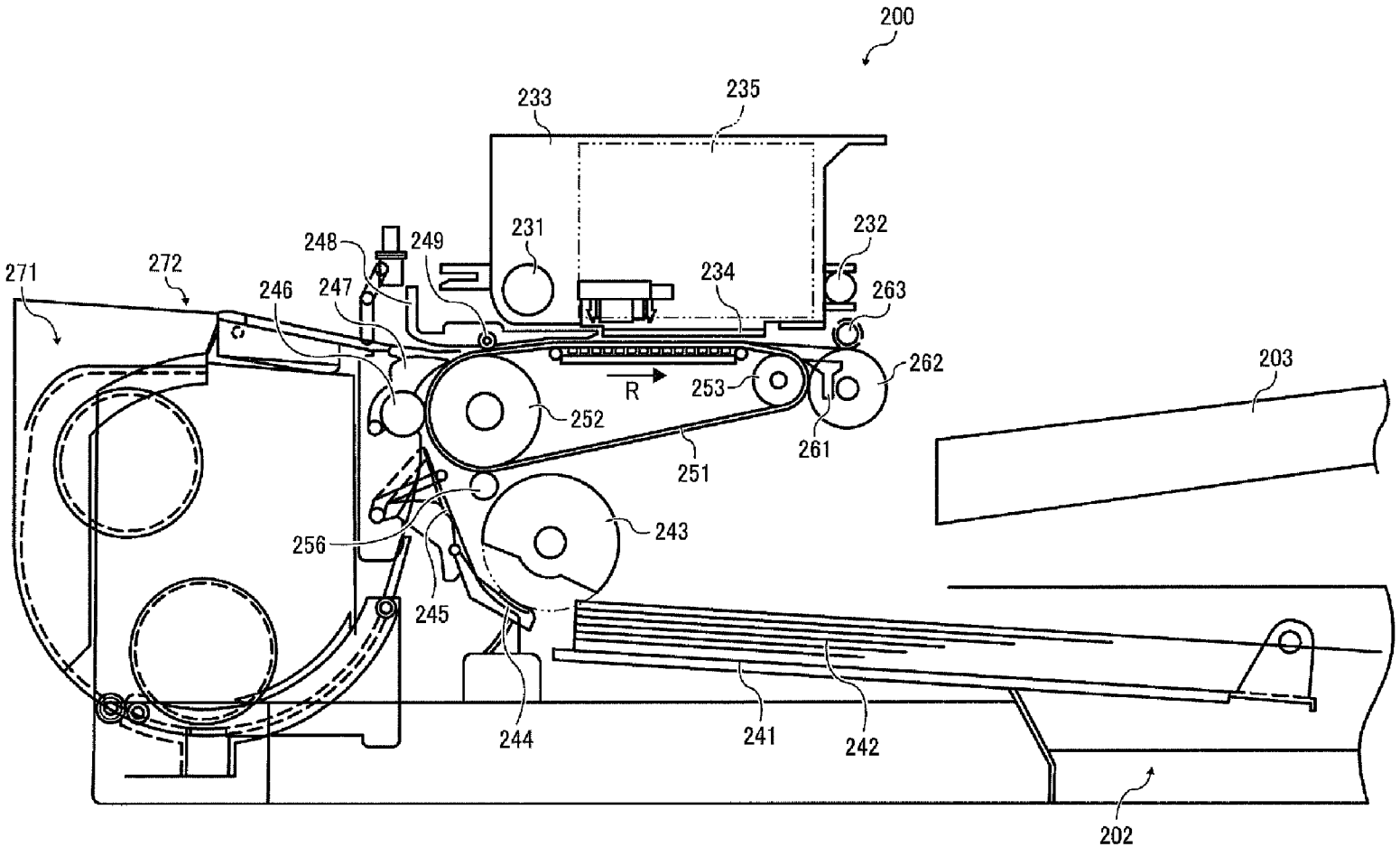
FIG. 1 is a schematic diagram illustrating a configuration of an image forming apparatus according to embodiments of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 2:
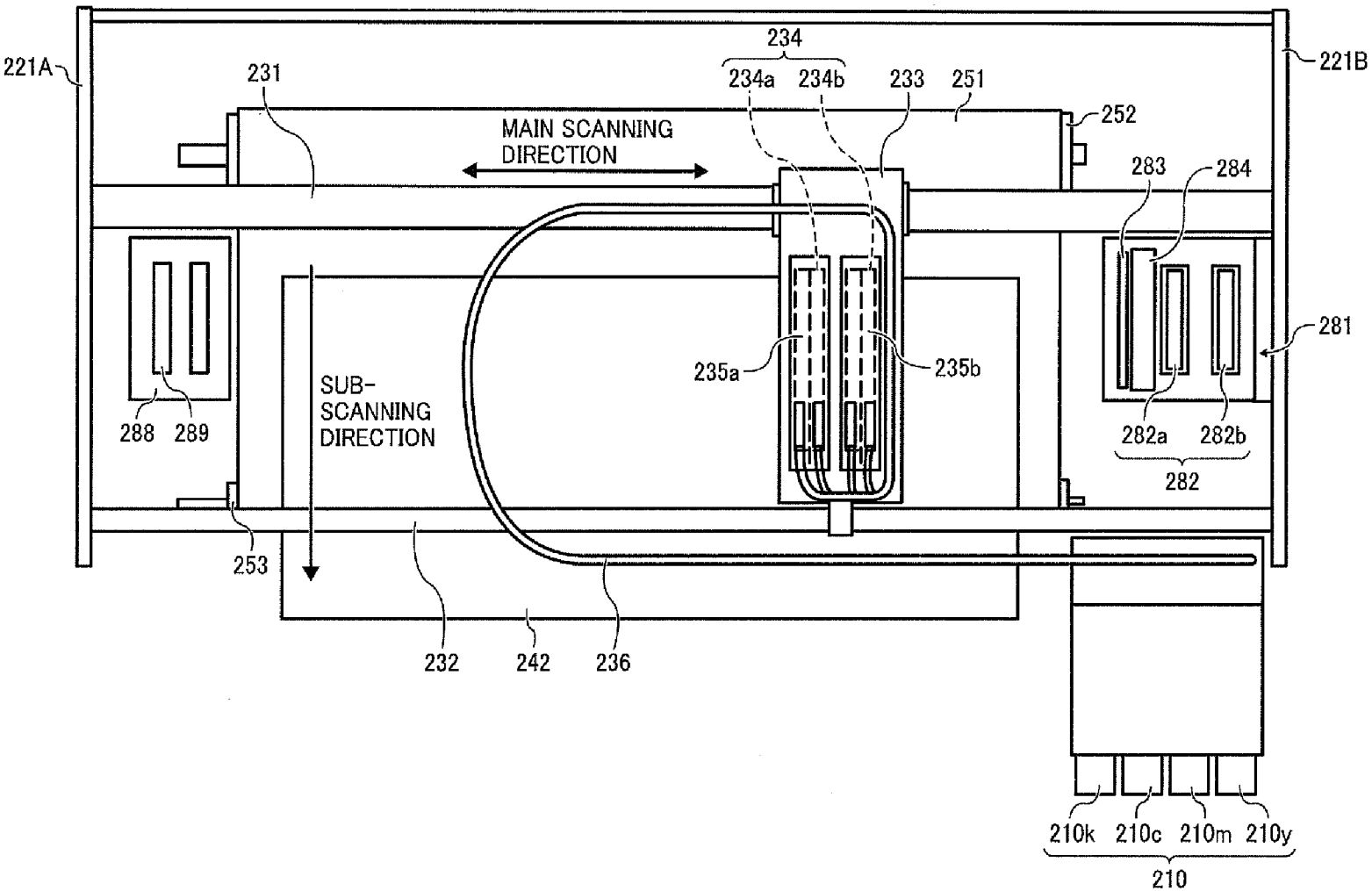
FIG. 2 is a plan view of the image forming apparatus shown in FIG. 1.

Referring now to the drawings, wherein like reference numerals designate identical or corresponding parts throughout the several views thereof, and particularly to FIGS. 1 and 2, an image forming apparatus using a liquid ejecting head according to an illustrative embodiment of the present invention is described.

It is to be noted that, in the present application, "image forming apparatus" means the device that ejects the ink to a recording medium, such as paper, thread, fiber, textile, metal, plastic, glass, ceramic, etc., so as to form images thereon, and "image forming" includes both forming on the recording medium an image including a pattern, etc., that has no commonly understood meaning as well as image including a letter and/or an illustration that does have a given meaning. Further, "ink" is not limited to only the materials generally called "ink" but also used as a generic term for the liquid, such as recording-liquid, fixing liquid, other liquid, etc., which can form images, such as, recording liquid, fixing processing liquid, a DNA sample, a registration, and pattern materials.

Moreover, "transfer sheet" includes not only paper but also any materials onto which ink can adhere, such as, an overhead projector (OHP) sheet, textile, etc., and is used as a generic term for a recording medium, recording paper, a recording sheet, etc.

FIG. 1 is a schematic view of an image forming apparatus 200. The image forming apparatus 200 includes an image forming device 201, a paper tray 202, a feed roller 243, a separation pad 244, a guide 245, a counter roller 246, a conveyance guide 247, a pressing member 248, a conveyance belt 251, a conveyance roller 252, a tension roller 253, a charging roller 256, a separation nail 261, output rollers 262 and 263, an output tray 203, a duplex unit 271, and a bypass tray 272.

The pressing member 248 includes a leading edge pressing roller 249. The image forming device 201 includes a main guide rod 231, a sub guide rod 232, a carriage 233, recording heads 234, and sub tanks 235. The paper tray 202 includes a sheet loading portion 241.

FIG. 2 is a plan view of the image forming device 201. The image forming device 201 includes a left side plate 221A, a right side plate 221B, ink cartridges 210, supply tubes 236, a maintenance-restoration mechanism 281, and an ink collection unit 288.

The recording heads 234 include recording heads 234A and 234B. The sub tanks 235 include sub tanks 235A and 235B. The ink cartridges 210 include ink cartridges 210K, 210C, 210M, and 210Y. The maintenance-restoration mechanism 281 includes caps 282, a wiper blade 283, and a preliminarily discharged droplet receiver 284. The caps 282 include caps 282A and 282B. The ink collection unit 288 includes openings 289.

The image forming apparatus 200 can be any of a copier, a printer, a facsimile machine, a plotter, and a multifunction printer including at least one of copying, printing, scanning, plotter, and facsimile functions. In this non-limiting exemplary embodiment, the image forming apparatus 200 functions as a serial-type printer for discharging liquid (e.g., ink or an ink droplet) to form an image on a recording medium (e.g., a recording sheet).

As illustrated in FIG. 2, the left side plate 221A and the right side plate 221B support the main guide rod 231 and the sub guide rod 232. The main guide rod 231 and the sub guide rod 232 serve as guide members for guiding the carriage 233. For example, the main guide rod 231 and the sub guide rod 232 support the carriage 233 in such a manner that the carriage 233 slides and moves on the main guide rod 231 and the sub guide rod 232 in a main scanning direction. A main scanning motor, not shown, moves the carriage 233 in the main scanning direction via a timing belt, not shown.

The recording heads 234A and 234B are mounted on the carriage 233 and serve as liquid ejecting heads for ejecting yellow, cyan, magenta, and black ink droplets, respectively. In each of the recording heads 234A and 234B, two nozzle rows, each of which is formed of a multiplicity of nozzles, extend in a sub-scanning direction perpendicular to the main scanning direction so that the multiplicity of nozzles discharges ink droplets downward.

Each of the recording heads 234A and 234B includes two nozzle rows. For example, in the recording head 234A, one nozzle row discharges black ink droplets and another nozzle row discharges cyan ink droplets. In the recording head 234B, one nozzle row discharges magenta ink droplets and another nozzle row discharges yellow ink droplets. According to this exemplary embodiment, the image forming apparatus 200 includes the two recording heads 234A and 234B for discharging ink droplets in the four colors. Alternatively, the image forming apparatus 200 may include four recording heads for discharging yellow, cyan, magenta, and black ink droplets, respectively. Yet alternatively, the image forming apparatus 200 may include a single recording head in which four nozzle rows, each of which includes a multiplicity of nozzles, discharge yellow, cyan, magenta, and black ink droplets, respectively.

The sub tanks 235A and 235B are mounted on the carriage 233 and correspond to the nozzle rows of the recording heads 234A and 234B to supply inks in corresponding colors to the recording heads 234A and 234B. The ink cartridges 210K, 210C, 210M, and 210Y contain black, cyan, magenta, and yellow inks, respectively. A supply unit, not shown, supplies the black, cyan, magenta, and yellow inks from the ink cartridges 210K, 210C, 210M, and 210Y to the sub tanks 235A and 235B via the supply tubes 236, respectively.

As illustrated in FIG. 1, in the paper tray 202, the sheet loading portion 241 (e.g., a pressure plate) loads sheets 242. The feed roller 243, having a half-moon-like shape, separates a sheet 242 from other sheets 242 loaded on the sheet loading portion 241 and feeds the separated sheet 242 toward the guide 245. The separation pad 244 opposes the feed roller 243 and includes a material having an increased friction coefficient. The separation pad 244 is pressed against the feed roller 243. The feed roller 243 and the separation pad 244 serve as a sheet supplier.

The guide 245 guides the sheet 242 fed by the sheet supplier toward the counter roller 246. The counter roller 246 feeds the sheet 242 toward the conveyance guide 247. The conveyance guide 247 guides the sheet 242 toward the pressing member 248. The leading edge pressing roller 249 of the pressing member 248 presses the sheet 242 against the conveyance belt 251. The conveyance belt 251 serves as a conveyer for conveying the sheet 242 at a position opposing the recording heads 234 by electrostatically attracting the sheet 242. Thus, the sheet 242 fed by the sheet supplier is sent to a position under the recording heads 234.

The conveyance belt 251, having an endless belt-like shape, is looped over the conveyance roller 252 and the tension roller 253 to rotate in a direction of rotation R (e.g., the sub-scanning direction). The charging roller 256 serves as a charger for charging a surface of the conveyance belt 251. The charging roller 256 contacts the surface of the conveyance belt 251 and is driven and rotated by rotation of the conveyance belt 251. A sub-scanning motor, not shown, drives and rotates the conveyance roller 252 via a timing belt so that the conveyance roller 252 rotates the conveyance belt 251 in the direction of rotation R.

The separation nail 261 and the output rollers 262 and 263 serve as an output device for discharging the sheet 242 bearing an image formed by the recording heads 234. For example, the separation nail 261 separates the sheet 242 from the conveyance belt 251. The output rollers 262 and 263 discharge the sheet 242 onto the output tray 203 provided beneath the output roller 262.

The duplex unit 271 is detachably attached to a rear portion of the image forming apparatus 200. The duplex unit 271 receives the sheet 242 fed by the conveyance belt 251 rotating backward, reverses the sheet 242, and feeds the sheet 242 toward a nip portion formed between the counter roller 246 and the conveyance belt 251. A top surface of the duplex unit 271 serves as the bypass tray 272.

As illustrated in FIG. 2, the maintenance-restoration mechanism 281 is disposed in a non-printing region provided in one end of the image forming device 201 in the main scanning direction in which the carriage 233 moves. The maintenance-restoration mechanism 281 serves as a maintenance-restoration device for maintaining and restoring a condition of the nozzles of the recording heads 234. In the maintenance-restoration mechanism 281, the caps 282A and 282B cap nozzle surfaces of the recording heads 234A and 234B, respectively. The wiper blade 283 wipes the nozzle surfaces of the recording heads 234. The preliminarily discharged droplet receiver 284 receives ink droplets discharged preliminarily and thereby not used for forming an image on the sheet 242 to discharge ink droplets having an increased viscosity.

The ink collection unit 288 (e.g., a preliminarily discharged droplet receiver) is disposed in another non-printing region provided in another end of the image forming device 201 in the main scanning direction in which the carriage 233 moves. The ink collection unit 288 serves as a liquid collection container for receiving ink droplets discharged preliminarily and thereby not used for forming an image on the sheet 242 to discharge ink droplets having an increased viscosity during an image forming operation and the like. In the ink collection unit 288, the openings 289 are arranged along the nozzle rows of the recording heads 234.

Referring to FIG. 1, the following describes an image forming operation performed in the image forming apparatus 200 having the above-described structure. The feed roller 243 and the separation pad 244 feed sheets 242 loaded on the paper tray 202 one by one upward toward the guide 245. The guide 245 guides the sheet 242 in a substantially vertical direction toward the nip portion formed between the counter roller 246 and the conveyance belt 251. The counter roller 246 and the conveyance belt 251 nip the sheet 242 and feed the sheet 242 toward the conveyance guide 247. The conveyance guide 247 guides a leading edge of the sheet 242 toward the leading edge pressing roller 249. The leading edge pressing roller 249 presses the sheet 242 against the conveyance belt 251 so that the conveyance belt 251 turns a sheet conveyance direction of the sheet 242 by about 90 degrees.

The charging roller 256 receives an alternating voltage in which positive output and negative output are alternately repeated. Accordingly, the conveyance belt 251 has an alternating charge voltage pattern. For example, the conveyance belt 251 is charged in such a manner that a positively charged band and a negatively charged band having a predetermined length are alternately provided in the sub-scanning direction in which the conveyance belt 251 rotates. When the sheet 242 is sent onto the conveyance belt 251 charged alternately with positive and negative voltages, the conveyance belt 251 attracts the sheet 242, and the rotating conveyance belt 251 conveys the sheet 242 in the sub-scanning direction.

While the carriage 233 moves, the recording heads 234 are driven according to an image signal. For example, the recording heads 234 eject ink droplets onto the sheet 242 stopped on the conveyance belt 251 to form an image of one line. After the conveyance belt 251 conveys the sheet 242 for a predetermined amount, the recording heads 234 form an image of a next one line. When the recording heads 234 receive an image formation completion signal or a signal indicating that a trailing edge of the sheet 242 reaches an image forming region, the image forming operation is finished, and the sheet 242 is output onto the output tray 203.

Descriptions will be given below of various embodiments of a liquid ejecting head that can be used as the recording heads 234 in the image forming apparatus 200, which functions as a printer. Alternatively, the liquid ejecting heads 300 though 304 may be used in an image forming apparatus which functions as a multifunction printer having at least one of copying, printing, plotter, and facsimile functions, for example. Further, the liquid ejecting heads 300 though 304 may be used in an image forming apparatus using liquid other than ink, fixing liquid, and/or the like.

Figure 3:
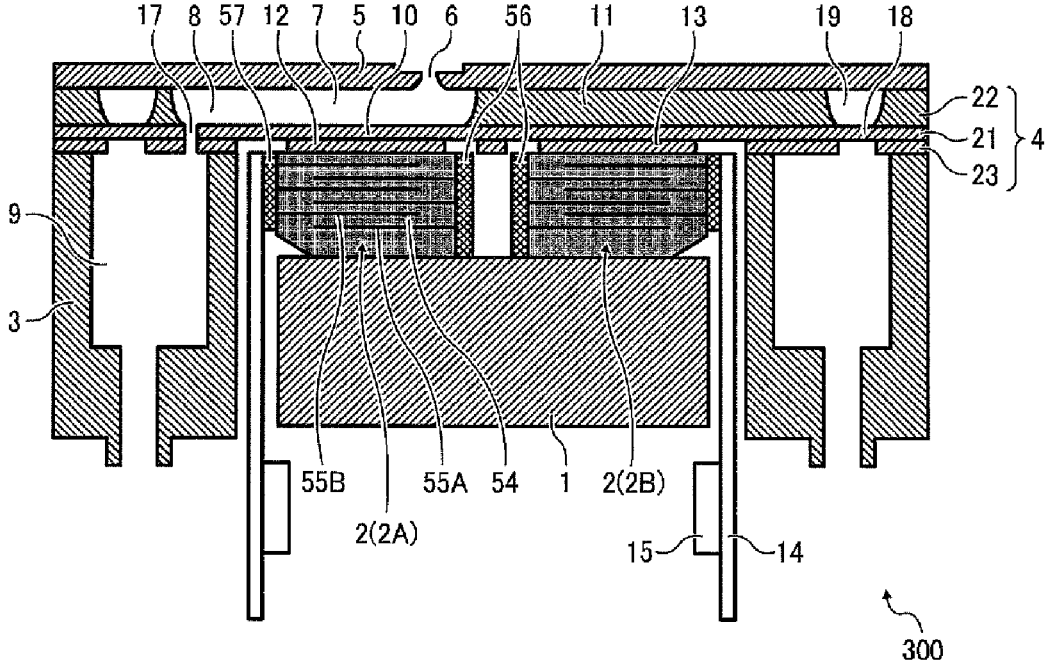
FIG. 3 is a cross-sectional view of a liquid ejecting head along a longitudinal direction of a compression chamber thereof, according to a first embodiment.
Figure 4:
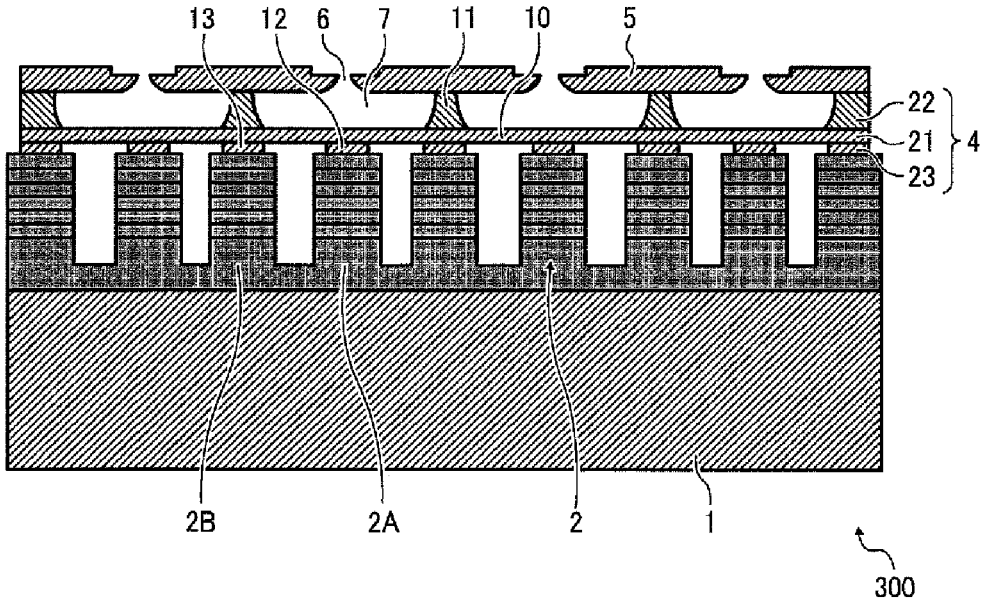
FIG. 4 is a cross-sectional view of the liquid ejecting head shown in FIG. 3 along a shorter side of the compression chamber thereof.

FIG. 3 is a cross-sectional view of a liquid ejecting head 300 taken along a longitudinal direction of a compression chamber 7 thereof (orthogonal to a direction of nozzle alignment). FIG. 4 is a cross-sectional view of the liquid ejecting head 300 taken along a shorter side of the compression chamber 7 (direction of nozzle alignment).

The liquid ejecting head 300 includes a base 1, a laminated piezo-electric element member 2, a frame 3, a vibration unit 4, a nozzle plate 5, a nozzle 6 to eject ink droplets, the compression chambers 7, a fluid resistance portion 8, and a common liquid chamber 9. In the laminated piezo-electric element member 2, multiple laminated piezo-electric element rods 2A and 2B that serve as activation mechanisms are disposed on the base 1. The frame 3 is disposed around the outer circumference of the base 1. The vibration unit 4 is disposed on the piezo-electric element member 2, and the nozzle plate 5 is disposed on the vibration unit 4. The compression chamber 7 is a route through which the ink is carried to the nozzle, and the common liquid chamber 9 supplies the ink to the compression chamber 7 through the fluid resistance portion 8 that is located between the common liquid chamber 9 and the compression chamber 7 and is narrower than the compression chamber 7.

The vibration unit 4 includes a vibration plate 10, partition walls 11, convex portions 12, and thick-walled portions 13. The vibration plate 10 is formed of an etching-resistant material that forms a bottom wall of the compression chamber 7.

Each partition wall 11 of the compression chamber 7, (a partition wall among liquid path) is a laminated structure disposed on an upper side of the vibration plate 10 and is formed of a material that can be etched. Each convex portion 12 is an island-shaped laminated structure (thick-wall portion) disposed on a lower side (outer surface) of the vibration plate 10 to connect to the piezo-electric element rod 2A and is formed of a material that can be etched (such as metal). Each thick-walled portion 13 is formed with a material identical or similar to that forming the convex portion 12 and is connected to the frame member 3 as well as the piezo-electric element rod 2B.

Each nozzle 6 is a hole formed in the nozzle plate 5, and has a diameter within a range of from 10 μm to 30 μm and is continuous with the compression chamber 7.

An ink ejecting surface of the nozzle plate 5 (nozzle surface side) is coated with a water-repellent film that is selected in accordance with the physical properties of the ink. For example, the water-repellent film is formed using PTFE (polytetrafluoroethylene)-Ni (nickel) eutectoid plating, electrocoating of fluorocarbon polymers, elaboration coating with evaporable fluorocarbon polymers (e.g., pitch fluoride), or baking after application of a solvent such as silicon resin, fluoroplastic, or the like. Thus, the shape of droplets and aerodynamics of the ink can be stabilized to provide high-quality imaging.

The piezo-electric element member 2 is located on the outer surface of the vibration plate 10 (opposite the compression chamber 7), and the position thereof corresponds to the compression chamber 7. The piezo-electric element member 2 serves as an activation mechanism that vibrates the vibration plate 10. The island convex portion 12 corresponding to piezo-electric element rod 2A and a thick portion 13 corresponding to piezo-electric element rod 2B contact the lower surface of the vibration plate 10, which is opposite surface of the compression chamber 7. A piezo-electric actuator that deforms the vibration plate 10 is formed with the vibration plate 10 and the piezo-electric element member 2.

For example, the piezo-electric member 2 can be formed of alternating piezo-electric layers 54 and internal electrode layers 55A and 55B. Each piezo-electric layer 54 has a thickness ranging from about 10 μm to about 50 μm and includes lead zirconate titanate (PZT). Each of the internal electrode layers 55A and 55B has a thickness ranging from several micrometers and includes silver-palladium (AgPd). The internal electrodes 55A and 55B are electrically connected alternately to individual electrodes 57 (e.g., an end face electrode or an external electrode) and a common electrode 56.

Then, the piezo-electric element member 2 is subjected to a slitting process without decoupling it, and thus the multiple piezo-electric rods 2A and 2B are formed. Each piezo-electric rod 2A is used as a driving-piezo-electric element rod that applies a driving waveform, and each piezo-electric rod 2B is used as not a driving piezo-electric element rod but a support rod corresponding to the partition wall 11. A flexible printed circuit (FPC) cable 14 that transmits the driving waveform is connected to the external electrode 57 disposed on one edge surface of the piezo-electric rod 2A in the piezo-electric element member 2.

A displacement in either a d33 direction or a d31 direction may be used as a piezoelectric direction of the piezo-electric element member 2 to compress the ink in the compress liquid chamber 7. According to this exemplary embodiment, the displacement in the d33 direction is used.

Further, it is preferred that the base 1 be formed of metal. When the base 1 is formed of metal, the piezo-electric element member 2 can be prevented from storing heat by self-heating. As the piezo-electric element member 2 is connected to the base 1 with adhesive, when the number of channels increases, the temperature of the piezo-electric element member 2 increases to close to 100° C. and the adhesive strength significantly decreases. When the temperature inside the liquid ejecting head 300 increases by self-heating, the liquid temperature increases. When the liquid temperature increases, the viscosity of the liquid decreases, substantially affecting ejecting characteristics.

Therefore, because the metal base 1 can prevent the piezo-electric element member 2 from storing heat from self-heating, the deterioration of the ejection characteristics caused by the decrease in the connection strength and the decrease in the liquid adhesive can be prevented.

On the FPC cables 14, multiple drivers IC 15 are mounted to generate the driving waveforms (electrical signals) that drive each channel corresponding to each compression chamber 7.

Further, the frame member 3 is connected to the outer circumference of the vibration unit 4 with adhesive. Then, in the frame member 3, the common liquid chamber 9 via which the ink is supplied from the external device to the compression chamber 7 is formed so as to be arranged opposite the driver IC 15 across at least the FPC cable 14.

The common liquid chamber 9 is continuous with the fluid resistance portion 8 and the compression chamber 7 via an ink supply port 17 in the vibration unit 4.

In the common liquid chamber 9, because a damper chamber 19 is formed by a diaphragm portion 18, a pressure wave that is generated in the common liquid chamber 9 by ejecting liquid is attenuated, and thus, the liquid can be stably ejected.

In the above-described liquid ejecting head 300, when the driving voltage is applied to the piezo-electric element member 2, the piezo-electric element member 2 is moved in the laminated direction, and the vibration plate 10 is deformed and moved to the side of the compression chamber 7. Thus, the capacity in the compression chamber 7 is decreased, and accordingly the pressure in the compression chamber 7 is increased, which causes the ink droplet to be ejected from the nozzle 6. At that time, the ink in the compression chamber 7 tries to enter the common ink chamber 9 through the fluid resistance portion 8. However, the fluid resistance portion 8 inhibits the ink from entering the common ink chamber 9, and thus, the ink can be effectively ejected.

Then, as the ink ejecting process is finished, the pressure of the ink in the compression chamber 7 is decreased, and negative pressure in the compression chamber 7 is generated by inertia flow of the ink and the discharge process of the driving voltage. Subsequently, the process proceeds to the process of supplying ink, and the ink is supplied from the common ink chamber 9 to the compression chamber 7 through the fluid resistance portion 8.

Then, when the vibration on the meniscus surface of the ink near the exit of the nozzle 6 is attenuated and the meniscus surface is returned to a steady state, the process proceeds to a subsequent ink ejecting process.

Next, a detailed configuration of the vibration unit 4 is described below with reference to FIGS. 5A through 5E in addition to FIGS. 3 and 4. Each of FIGS. 5A through 5E is a cross-sectional diagram illustrating a manufacturing process of the vibration unit 4 according to the first embodiment. It is to be noted that a different type of the vibration unit 4 is described below, and therefore, the configuration shown in FIGS. 3A through 3E is not necessarily the same as the configuration shown in FIGS. 1 and 2.

Figure 5A:
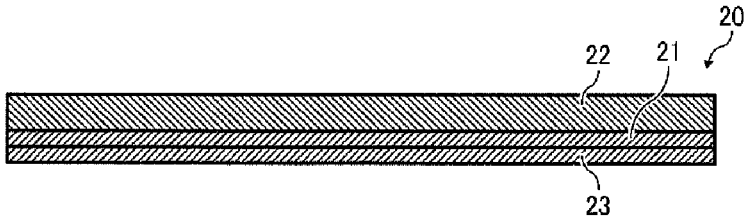
FIGS. 5A through 5E are cross section diagrams illustrating respective manufacturing processes of a vibration unit of the liquid ejecting head according to the first embodiment.

The vibration unit 4 is formed of a three-layered laminated member 20. In center of the laminated member 20, a resin layer 21 formed of etching-resistant material such as polyimide (PI) or polyphenylensulfide (PPS) is formed. As shown in FIG. 5A, the resin layer 21 is sandwiched by a first metal layer 22 disposed on an upper side thereof and a second metal layer 23 disposed on a lower side thereof.

The first and second metal layers 22 and 23 are formed of different metals. As shown in FIG. 5A, in the present embodiment, as the material of the laminated member 20, the first metal layer 22 is formed of chromium (Cr) whose ionization tendency is higher than hydrogen (H), and the second metal layer 23 is formed of copper (Cu) whose ionization tendency is lower than hydrogen.

Figure 5B:
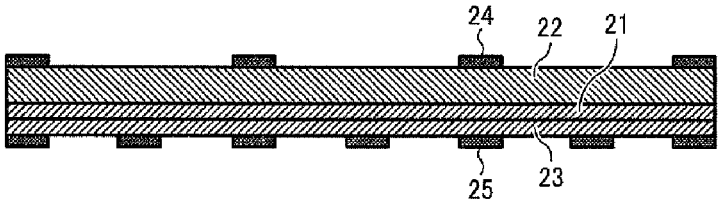

Initially, the entire surface of the laminated member 20 is coated with a photo-resist, and then patterning of the photo-resist is executed, as shown in FIG. 5B. As a result, a resist pattern 24 opened at portions corresponding to the compression chambers 7 is formed on the side of the first metal layer 22, and a resist pattern 25 opened at portions except the convex portions 12 and the thick-walled portions 13 is formed on the side of the second metal layer 23.

Figure 5C:
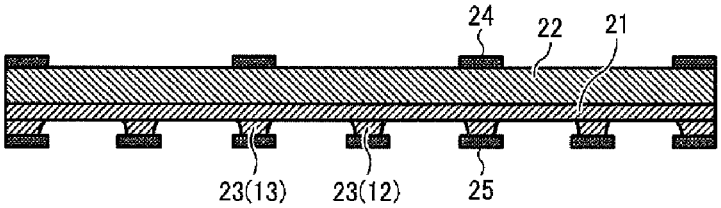

Subsequently, as shown in FIG. 5C, the second metal layer 23 is etched by ammonia water. Herein, as described above, the metal whose ionization tendency is higher than hydrogen is selected for the first metal layer 22, and the metal whose ionization tendency is lower than hydrogen is selected for the second metal layer 23. Because the first metal layer 22 whose ionization tendency is higher than hydrogen generally has higher resistivity against alkalinity, the first metal layer 22 is not etched. Therefore, only the second metal layer 23 can be etched without protecting the first metal layer 22. The etching operation is stopped when the resin layer 21, which is an etching-resistant member, is exposed, and thus the second metal layer 23 that can be etched is engraved.

Figure 5D:
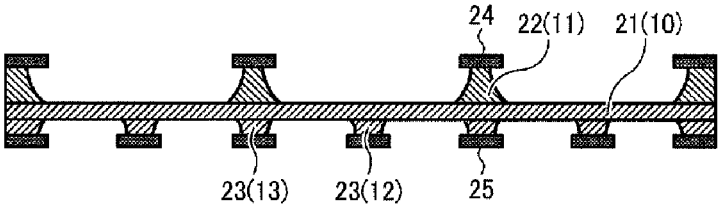

Next, as shown in FIG. 5D, the first metal layer 22 is etched by hydrochloric acid (HCl). Because the ionization tendency of the second metal layer 23 is lower than hydrogen, the second metal layer 23 can be resistant against acid and is not engraved.

Figure 5E:
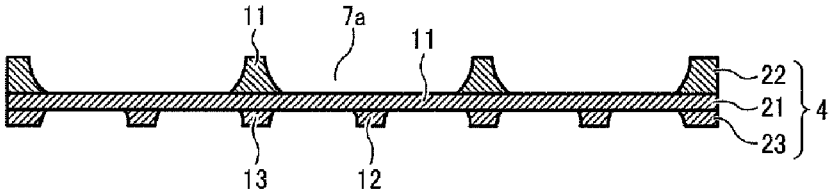

Thereafter, as shown in FIG. 5E, the resist patterns 24 and 25 are removed so that the partition walls 11 serving as structures and concave portions 7*a* each of which forms the compression chamber 7 are formed with the first metal layer 22, the convex portion 12 and the thick-walled portion 13 are formed with the second metal layer 23, and the vibration plate 10 is formed with the resin layer 21. Thus, the vibration unit 4 is obtained.

The etching rate of the second metal layer 23 whose ionization tendency is lower than hydrogen is slower than that of the first metal layer 22 whose ionization tendency is higher than hydrogen. Therefore, the convex portion 12 and the thick-walled portion 13 can be formed with a higher degree of accuracy from the second metal layer 23 whose ionization tendency is lower than hydrogen, and the partition wall 11 and the concave portion 7*a* forming the compression chamber 7 can be formed in a shorter time even with their greater thickness.

As for the triple-layer laminated member 20, for example, commercial triple-layered members, such as stainless steel-polyimide-copper layered members can be used. Alternatively, etching can be executed after the three layers are connected in advance.

In this case, whether the etching process was executed before the connection process or after the connection process can be relatively easily distinguished because, when the etching is executed after the three layers are adhered together, there are no or almost no protrusions of the adhesion layer on the edge portion of the pattern.

Further, regarding the connection between the etching-resistant layer and the layer that can be etched, a surface betterment layer that enhances connection force of the adhesive layer may be formed. In this case, although the laminated member 20 appears to have layers in excess of three layers, such a configuration is not beyond the scope of the present invention.

As described above, the vibration plate 10 is formed of the etching-resistant resin member 21, and the triple-layer member is formed by sandwiching the vibration plate 10 with different metals. Therefore, the structure located on both sides of the vibration plate is formed with a metal that can be etched, without misalignment. Further, the vibration unit 4 can be produced relatively easily and at low cost, and a liquid ejecting head whose degree of assembly accuracy is high can be produced at low cost.

Further, as described above, the ionization tendencies of the different metals are different, that is, one has an ionization tendency higher than that of hydrogen and the other has an ionization tendency lower than that of hydrogen. Therefore, etching characteristics of these metals are different. Since the two metal layers are etched using different etching liquid, one metal layer can be etched without masking the other metal layer. Therefore, etching time can be set optimally for the thickness of metal layer or the pattern respectively, and flexibility in setting the thickness of metal layer or the pattern can be increased. Therefore, a liquid ejecting head with excellent characteristic can be obtained.

As the metal whose ionization tendency is higher than hydrogen, for example, magnesium (Mg), titanium (Ti), aluminum (Al), chromium (Cr), iron (Fe), nickel (Ni), or stainless steel such as SUS304, SUS316 and SUS430 formed of an alloy of chromium, iron, and nickel, can be used. As the metal whose ionization tendency is lower than hydrogen, for example, copper (Cu), silver (Ag), gold (Au), or platinum (Pt) can be used.

It is to be noted that, although in the present embodiment, the partition wall 11 is formed of the first metal layer 22 whose ionization tendency is higher than hydrogen and the convex portions 12 and thick-walled portions 13 are formed of the second metal layer 23 whose ionization tendency is lower than hydrogen, this invention is not limited to the specific present embodiment. That is, the partition wall 11 can be formed of the second metal layer whose ionization tendency is lower than hydrogen, and the convex portions 12 and thick-walled portions 13 can be formed of the first metal layer whose ionization tendency is higher than hydrogen. However, it is preferable that the partition wall 11 is formed of the first metal layer 22 whose ionization tendency is higher than hydrogen, as shown in the present embodiment, because the metal whose ionization tendency is higher than hydrogen generally has higher resistivity against alkalinity. When the liquid ejecting head 300 is used as the liquid ejecting head, high resistivity against alkalinity is required for the partition wall that mainly contacts the ink directly because the ink for ink jet image forming apparatuses is alkalinity. Therefore, the partition wall 11 is formed of the metal whose ionization tendency is higher than hydrogen, and thus, the liquid ejecting head 300 can have higher resistivity against the ink and have increased durability.

Further, because the resin layer 21 is electrically insulative, the resin layer 21 can isolate the first metal layer 22 from the second metal layer 23, which can prevent the first metal layer 22 and the second metal layer 23 from forming a battery when the compression chamber 7 and the common liquid chamber 9 are filled with the ink, and thus preventing the metal material from liquating out.

Additionally, although the first metal layer 22 is etched after the second metal layer 23 is etched in the present embodiment, the order of the etching process can be permutated as appropriate.

In the above-described several configurations, the vibration plate 10 and the partition walls 11 can be integrally formed as a single unit, and the patterns are formed after these members are connected. As a result, misalignment can be caused by only the masking position of both sides, and the convex portions 12 can be positioned with respect to the compression chamber 7 with a higher degree of accuracy. Additionally, the protrusion to the connection portion is decreased, and a higher degree of shape accuracy can be achieved.

A part of both the partition wall 11 and the thick-walled portion 13 formed in this manner contact the ink, and therefore those members are required to have high resistivity against ink. However, even if the material of those members has low resistivity against ink, the ink resistivity can be enhanced by coating the surface of the material with an appropriate organic or inorganic material. Such a coated configuration is within the scope of the present invention.

As the etching-resistant material that forms the vibration plate 10 in the vibration unit 4, the resin layer 21 is preferable. The deformation of the driving mechanism should be efficiently transmitted by the etching-resistant material that forms vibration plate, and the vibration should not be transmitted to the structure around the etching-resistant material. Therefore, it is preferable that the vibration plate 10 be formed of the resin material that has a relatively low stiffness. When the vibration is transmitted to the surrounding structure such as the partition wall 11, the compression chamber 7 and the nozzle 6 are vibrated in conjunction with the partition wall 11, and therefore the ejecting operation can be significantly destabilized.

By contrast, when the vibration 10 is formed of the resin layer 21, less vibration can be transmitted to the surrounding structure because the rate of Young's modulus of resin is lower by two orders of magnitude than that of materials such as metal, and the resin material is soft.

As the resin layer 21, for example, acrylic resin, polyimide resin, or aramid resin can be used. However, because the vibration plate 10 contacts the ink, it is favorable that the resin layer 23 has a relatively high resistibility against ink. As a high ink-resistant resin, for example polyimide resin, aramid resin, or the like can be used.

Even if the vibration material is formed of low ink-resistant resin, the ink resistivity can be enhanced by coating the surface of the resin with an appropriate organic or inorganic material. Such a coated configuration is within the scope of the present invention. Because the vibration plate formed of the resin has a relatively low rate of Young's modulus, the vibration plate can be relatively thick, that is, with a thickness within a range of from 5 μm to 100 μm. With such a thickness, pin-hole defects are seldom generated in the vibration plate and its handling is relatively easy, which can boost process yield.

Second Embodiment

Figure 6:
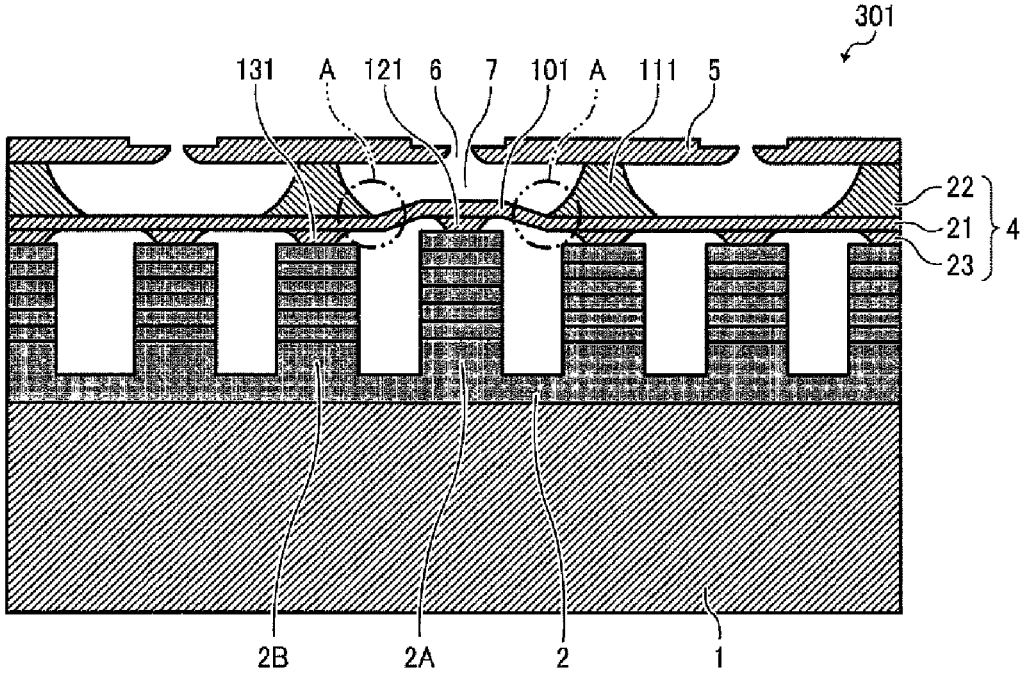
FIG. 6 is a cross-sectional view of a liquid ejecting head taken along a shorter side of the compression chamber, according to a second embodiment.

Next, a second embodiment of the present invention is described below with reference to the FIG. 6. FIG. 6 is a cross-sectional view of a liquid ejecting head 301 taken along a shorter side of the compression chamber 7 (direction of nozzle alignment). In the present embodiment, similar to the first embodiment, the first metal layer 22 forms a partition wall 111, and the second metal layer 23 forms a thick-walled portion 131 that is located between the resin layer 21 and the piezo-electric element member 2 serving as the driving mechanism and located in a corresponding portion of the partition wall 111.

In the portion in which the pattern of the first metal layer 22 faces the pattern of the second metal layer 23, the area of partition wall 111 that is the pattern of the first metal layer 22 is larger than the area of the thick-wall portion 131 that is the pattern of the second metal layer 23. Namely, the area of a planar portion of the partition wall 111 is larger than the area of a planar portion of the thick-wall portion 131 that corresponds to the partition wall 111.

In the present embodiment, similarly to the first embodiment, the displacement in the d33 direction is used as a piezoelectric direction of the piezoelectric element member 2 to move and deform the vibration plate 101 in a direction toward the compression chamber 7, and thus, the nozzle 6 ejects ink droplets.

When the displacement in the d33 direction is thus used as a piezo-electric direction of the piezo-electric element member 2 to compress the ink in the liquid chamber 7 by moving and deforming the vibration plate 101 in the direction toward the liquid chamber 7, in order not to degrade the polarization of the piezo-electric element member 2, voltage is applied in the same direction as the polarization direction.

Therefore, when the displacement in the d33 direction is used, as shown in FIG. 6, the piezo-electric element rod 2A in the piezo-electric element member 2 deforms in a direction in which the vibration plate 101 is pressed. When the piezo-electric element rod 2A deforms, the vibration plate 101 receives stress at fixed end portions surrounded by dashed line circle A in FIG. 6.

At this time, the partition wall 111 that is the pattern of the first metal layer 21 is larger than the thick-wall portion 131 that is the pattern of the second metal layer 23. As a result, the force to peel the partition wall 111 or the thick-wall portion 131 from the vibration plate 101 acting on the connection face between the vibration plate 101 and the partition wall 111 or the thick-wall portion 131 can be reduced. Therefore, durability against peeling at the connection face between the vibration plate 101 and partition wall 111 or the thick-wall portion 131 can be increased.

Further, when the piezo-electric element member 2 is vibrated at a relatively high frequency, an edge portion of the partition wall 111 is stressed. Therefore, the reliability of the connection face between the partition wall 111 and the resin member 21 may be damaged over time.

However, as described above, because the partition wall 111 is formed with the first metal layer 21 whose ionization tendency is higher than hydrogen, a metal oxide film tends to be formed on the surface of the first metal layer 21. Since the metal oxide film includes a hydroxyl group and goes well together with the resin layer 21 and adhesive, the reliability of the connection between the partition wall 111 and resin layer 21 can be enhanced.

Third Embodiment

Figure 7:
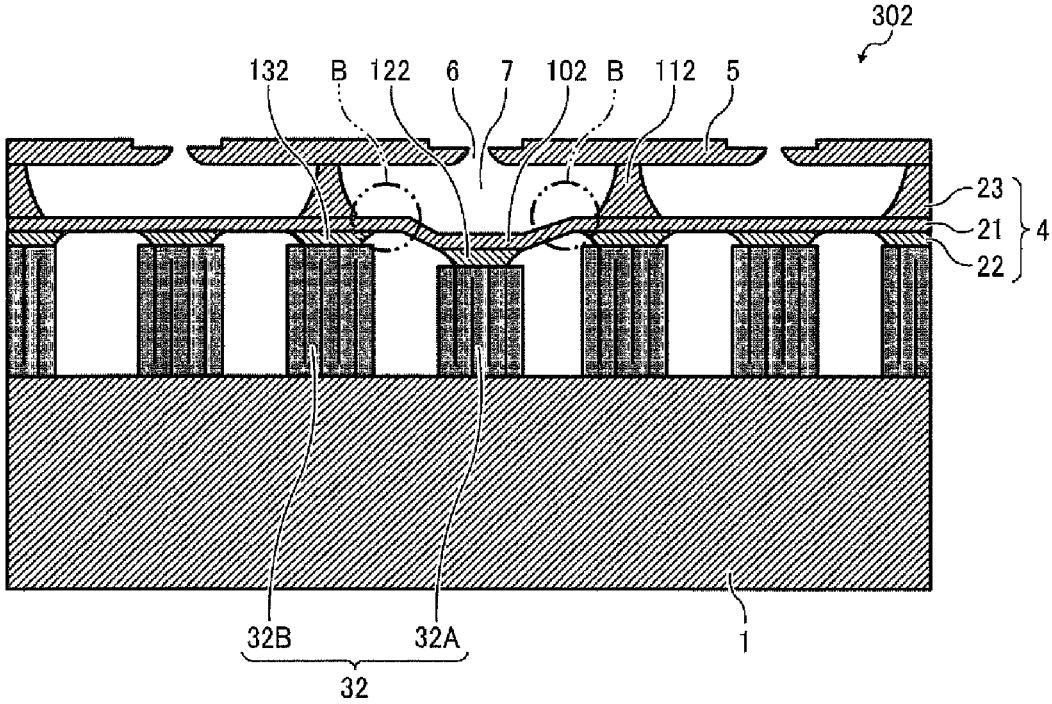
FIG. 7 is a cross-sectional view of a liquid ejecting head taken along a shorter side of the compression chamber, according to a third embodiment.

Next, the third embodiment of the present invention is described below with reference to the FIG. 7. FIG. 7 is a cross-sectional view of a liquid ejecting head 302 taken along a shorter side of the compression chamber 7 (direction of nozzle alignment).

In the present embodiment, by contrast to the first embodiment, the second metal layer 23 forms a partition wall 112, and the first metal layer 22 forms a thick-walled portion 132 that is located between the resin layer 21 and a non-driving piezo-electric element rod 32B serving as a support rod and located in a corresponding portion of the partition wall 112.

In the portion in which the pattern of the first metal layer 22 faces the pattern of the second metal layer 23, the area of thick-wall portion 132 that is pattern of the first metal layer 22 is larger than the area of the partition wall 112 that is the pattern of the second metal layer 23. Namely, the area of a planar portion of the thick-wall portion 132 that corresponds to the partition wall 112 is larger than the area of a planar portion of the partition wall 112.

In the present embodiment, differently from the first embodiment, a piezo-electric element member 32 that includes a driving piezo-electric element rod 32A and the non-driving piezo-electric element rod 32B is disposed on the base 1.

Then, the displacement in the d31 direction is used as a piezoelectric direction of the piezo-electric element member 32 to move and deform the vibration plate 102 in a direction opposite to the liquid chamber 7, and thus, the nozzle 6 ejects ink droplets.

In this way, the displacement in the d31 direction is used as a piezo-electric direction of the piezo-electric element member 32 to compress the ink in the liquid chamber 7 using a force of the vibration plate 102 to return from the deformation in the direction opposite to the compress liquid chamber 7.

In this case, because the piezo-electric element rod 32A in the piezo-electric element member 2 deforms in a direction in which the vibration plate 102 is pulled as shown in FIG. 7, the vibration plate 102 receives a relatively large stress at fixed end portions surrounded by dashed line circle B in FIG. 7.

At this time, the thick-wall portion 132 that is the pattern of the first metal layer 21 is larger than the partition wall 112 that is the pattern of the second metal layer 23. As a result, the force to peel the partition wall 112 or the thick-wall portion 132 from the vibration plate 102 acting on the connection face between the vibration plate 102 and the partition wall 112 or the thick-wall portion 132 can be reduced. Therefore, durability against peeling at the connection face between the vibration plate 102 and partition wall 112 or the thick-wall portion 132 can be increased.

Further, when the piezo-electric element member 2 is vibrated at a relatively high frequency, an edge portion of the partition wall 112 is stressed. Therefore, the reliability of the connection face between the thick-wall portion 132 and the resin member 21 may be damaged over time. However, as described above, because the thick-wall portion 132 is formed with the first metal layer 21 whose ionization tendency is higher than hydrogen, a metal oxide film tends to be formed on the surface of the first metal layer 21. Since the metal oxide film includes a hydroxyl group and goes well together with the resin layer 21 and adhesive, the reliability of the connection between the thick-wall portion 132 and resin layer 21 can be enhanced.

Fourth Embodiment

Next, the fourth embodiment of the present invention is described below with reference to the FIGS. 8A through 8E. Each of FIGS. 8A through 8E is a cross section diagram illustrating a manufacturing process of the vibration unit 4A according to the fourth embodiment.

Figure 8A:
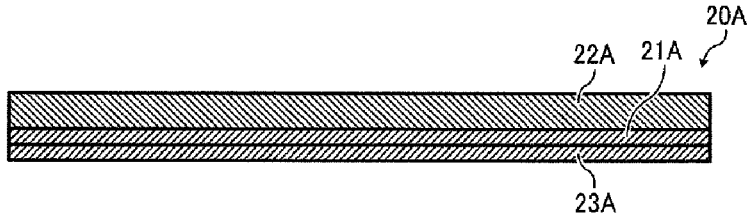
FIGS. 8A through 8E are cross-sectional diagrams illustrating respective manufacturing processes of the vibration unit of the liquid ejecting head according to a fourth embodiment.

The vibration unit 4A is formed of a three-layered laminated member 20A. In center of the laminated member 20A, a resin layer 21A formed of etching-resistant material such as polyimide (PI) or polyphenylensulfide (PPS) is formed. As shown in FIG. 8A, the resin layer 21A is sandwiched by a first metal layer 22A disposed on an upper side thereof and a second metal layer 23A disposed on a lower side thereof that are formed of different metals.

As shown in FIG. 8A, In the present embodiment, as the material of the laminated member 20A, the first metal layer 22A is formed of SUS304H whose ionization tendency is higher than hydrogen, and the second metal layer 23A is formed of copper whose ionization tendency is lower than hydrogen.

Figure 8B:
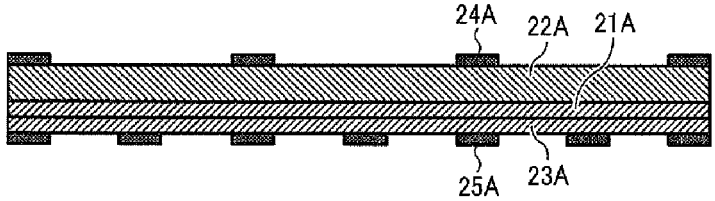

Initially, the entire surface of the laminated member 20A is coated with a photo-resist, and then, as shown in FIG. 8B, patterning of the photo-resist is executed. As a result, a resist pattern 24A opened at portions corresponding to the compression chambers 73 is formed on the side of the first metal layer 22A, and a resist pattern 25A opened at portions except the convex portions 123 and the thick-walled portions 133 is formed on the side of the second metal layer 23A.

Figure 8C:
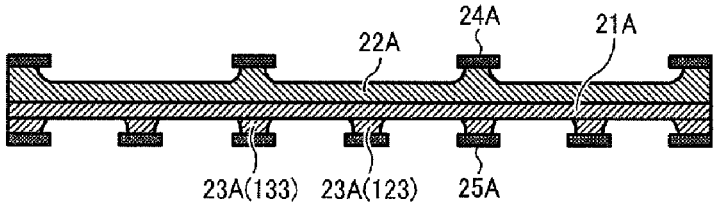

Subsequently, as shown in FIG. 8C, the second metal layer 23 and the second metal layer 23A are etched by Iron(II) chloride ($FeCl_2$) serving as a first etching liquid. Iron(II) chloride can etch both metals of SUS304H that forms the first metal layer 22A and copper that forms the second metal layer 23A. The etching operation is stopped when the resin layer 21A, which is etching-resistant member, is exposed, and thus the first metal layer 22A and the second metal layer 23A that can be etched are engraved.

Figure 8D:
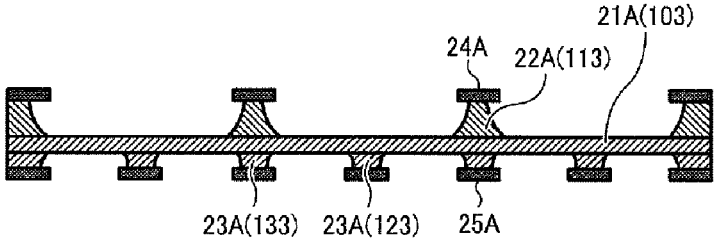

Next, as shown in FIG. 8D, the first metal layer 22A is etched by a liquid mixture of hydrochloric acid (HCl) and nitric acid ($HNO_3$), serving as a second etching liquid.

Because the ionization tendency of the second metal layer 23 is lower than hydrogen, the second metal layer 23A can be resistant against acid and is not engraved.

Figure 8E:
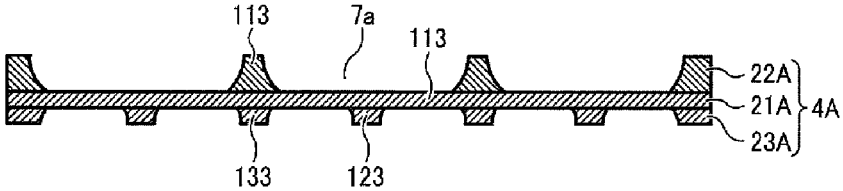

Thereafter, as shown in FIG. 8E, the resist patterns 24A and 25A are removed so that the partition walls 113 serving as structures and concave portions 7*a* each of which forms the compression chamber 73 are formed with the first metal layer 22A, the convex portion 123 and the thick-walled portion 133 are formed with the second metal layer 23A, and the vibration plate 103 is formed with the resin layer 21A. Thus, the vibration unit 4A is obtained.

As described above, in the present embodiment, Iron(II) chloride serving as the first etching liquid etches both metals of SUS304H that forms the first metal layer 22A and copper that forms the second metal layer 23A, and thereafter, the liquid mixture of hydrochloric acid and nitric acid serving as the second etching liquid etches SUS304H that forms the first metal layer 22A.

Because the second etching liquid cannot engrave the second metal layer 23A, the shape of the second metal layer 23A is determined in accordance with the first etching. On the other hand, because the first metal layer 22A is engraved also by the first etching liquid, the etching process in which the first metal layer 22A is engraved by the second etching liquid can require less time. Therefore, production time shortens and the cost of production can be reduced.

Fifth Embodiment

Figure 9:
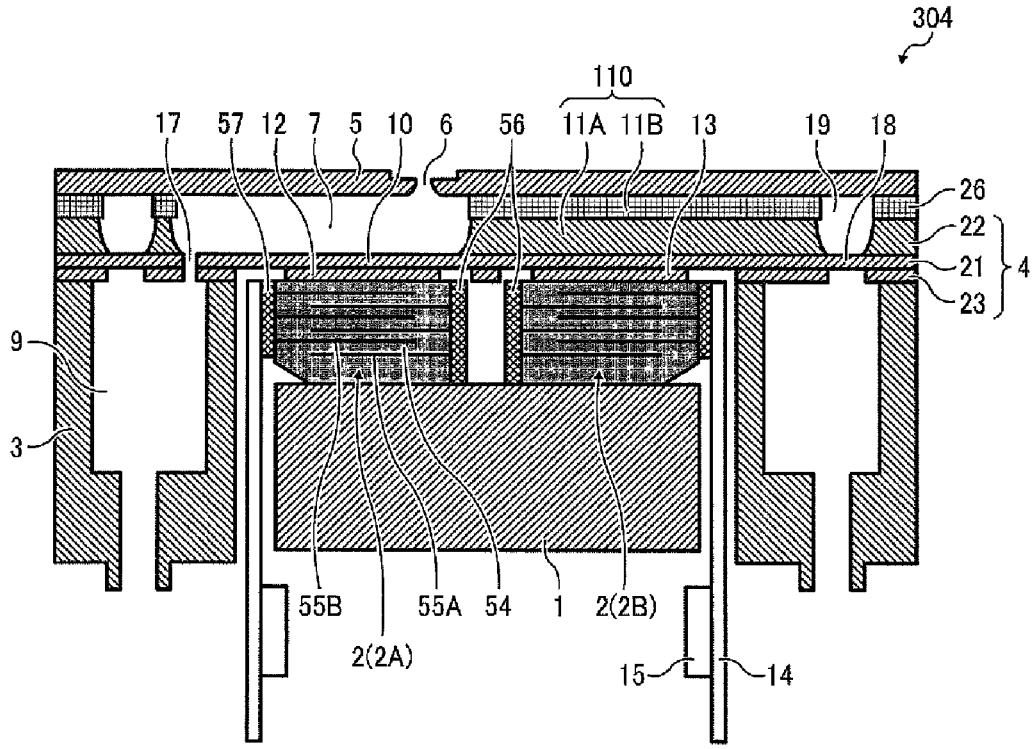
FIG. 9 is a cross-sectional view of a liquid ejecting head taken along a longitudinal direction of a compression chamber thereof, according to a fifth embodiment.
Figure 10:
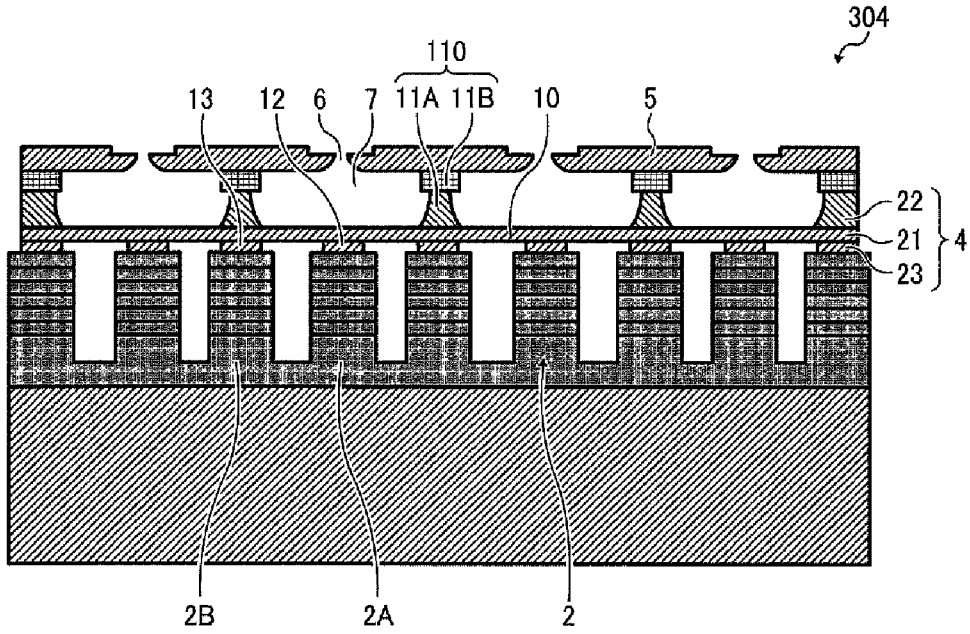
FIG. 10 is a cross-sectional view of the liquid ejecting head shown in FIG. 9 taken along a shorter side of the compression chamber.

Next, a fifth embodiment of the present invention is described below with reference to FIGS. 9 and 10. FIG. 9 is a cross-sectional view of a liquid ejecting head 304 taken along a longitudinal direction of a compression chamber 7 thereof (orthogonal to a direction of nozzle alignment). FIG. 10 is a cross-sectional view of the liquid ejecting head 304 taken along a shorter side of the compression chamber 7 (direction of nozzle alignment).

In the present embodiment, a partition wall 110 is a double-layer structure that consists of a lower partition wall 11A and an upper partition wall 11B.

The lower partition wall 11A is formed with the first metal layer 22 in the vibration unit 4, and the upper partition wall 11B that is formed with a liquid chamber member 26 is stacked on the lower partition wall 11A.

The liquid chamber member 26 is formed by processing such as etching and pressing and is adhesively connected to the lower partition wall 11A. The partition wall 110 requires a certain height so as to contain a certain amount of flowing liquid.

However, because the lower partition wall 11A that is formed of the first metal layer 22 in the vibration unit 4 is formed by etching, when the compression chambers 7 are arranged relatively closely to each other, the lower partition wall 11A cannot be formed unless the height thereof is reduced. To solve this problem, the liquid chamber member 26 that is a separate member is provided on the lower partition wall 11A so that the height of the partition wall 110 can be increased even if the compression chambers 7 are arranged at high density.

The above-described various embodiments are applicable to a cartridge integrated with a liquid ejecting head or liquid ejecting head integrated with a cartridge, which is a liquid ejecting head integrally connected with the cartridge that supplies the ink to the liquid ejecting head.

Then, as described above, one of liquid ejecting heads 300, 302, or 304 can be used as the recording head in the image forming apparatus 200 shown in FIG. 1, manufactured through any of the methods shown in FIGS. 5A trough 5E or FIGS. 8A though 8E. Therefore, the configuration can reduce production cost and provide improved reliability of the recording heads 234 and stable image formation.

It is to be noted that, although according to the above-described embodiments the liquid ejecting heads can be used in the image forming apparatus 200, which functions as a printer, the image forming apparatus is not limited thereto. Alternatively, the above described liquid ejecting heads may be used in an image forming apparatus which functions as a multifunction printer having at least one of copying, printing, plotter, and facsimile functions, for example. Further, the liquid ejecting heads 300 though 304 may be used in an image forming apparatus using liquid other than ink, fixing liquid, and/or the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. A liquid ejecting head comprising:
multiple nozzles to eject liquid droplet;
a vibration unit including a vibration plate, the vibration plate forming at least a wall face of multiple liquid paths that communicate with the respective nozzles; and
a driving member to move the vibration plate,
the vibration unit formed of a laminated multi-layered member comprising:
a resin layer constituting the vibration plate;
a first metal layer provided on a first side of the resin layer; and
a second metal layer provided on a second side of the resin layer opposite the first side of the resin layer,
wherein the first and second metal layers are formed of different metals,
the first metal layer having an ionization tendency higher than that of hydrogen,
the second metal layer having an ionization tendency lower than that of hydrogen.

2. The liquid ejecting head according to claim 1, wherein the first metal layer forms at least a part of one or more partition walls of the multiple liquid paths.

3. The liquid ejecting head according to claim 1, wherein the first metal layer in the vibration unit forms at least a part of one or more partition walls of the multiple liquid paths,
the second metal layer forms one or more corresponding portions to the partition walls across the resin layer,
the area of a planar portion of the partition walls formed of the first layer is larger than the area of a planar portion of the corresponding portions formed of the second layer, and
the driving member moves and deforms the vibration plate in a direction toward the liquid paths to cause the nozzles to eject ink droplets.

4. The liquid ejecting head according to claim 1, wherein the second metal layer forms at least a part of one or more partition walls of the multiple liquid paths.

5. The liquid ejecting head according to claim 1, wherein the second metal layer in the vibration unit forms at least a part of one or more partition walls of the multiple liquid paths,
the first metal layer forms one or more corresponding portions to the partition walls across the resin layer,
the area of a planar portion of the corresponding portions formed of the second layer is larger than the area of a planar portion of the partition walls formed of the first layer, and the driving member moves and deforms the vibration plate in a direction away from the liquid path to cause the nozzles to eject ink droplets.

6. An image forming apparatus comprising:

a liquid ejecting head to eject ink droplets; and a transport mechanism disposed facing the recording head to transport a sheet of a recording medium, the liquid ejecting head comprising:

multiple nozzles to eject liquid droplet;

a vibration unit forming a vibration plate to form at least one partition walls of multiple liquid path that communicates with the multiple nozzles; and a driving member to move the vibration plate in the vibration unit, the vibration unit formed of a laminated multi-layer member comprising:

a resin layer constituting the vibration plate;

a first metal layer provided on a first side of the resin layer;

a second metal layer provided on a second side of the resign layer opposite the first side of the resin layer, wherein the first and second metal layers are formed of different metals, the first metal layer having an ionization tendency higher than that of hydrogen, the second metal layer having an ionization tendency lower than that of hydrogen.

7. A method for manufacturing a liquid ejecting head, the liquid ejecting head comprising:

multiple nozzles to eject liquid droplet;

a vibration unit including a vibration plate to form at least a wall face of multiple liquid paths that communicate with the respective nozzles; and a driving member to move the vibration plate, the manufacturing method comprising:

forming the vibration unit using a laminated multi-layered member comprising a resin layer to form the vibration plate, a first metal layer provided on a first side of the resin layer, and a second metal layer provided on a second side of the resin layer opposite the first side of the resin layer;

etching the first metal layer and the second metal layer; and forming predetermined patterns on the first and second sides of the resin layer;

wherein, the first metal layer having an ionization tendency higher than that of hydrogen, and the second metal layer having an ionization tendency lower than that of hydrogen.

8. The method for manufacturing the liquid ejecting head according to claim 7, wherein the first metal layer and the second metal layer are etched by different etching liquids.

9. The method for manufacturing the liquid ejecting head according to claim 7, wherein the first metal layer and the second metal layer are etched by a first etching liquid, and either the first metal layer or the second metal layer is etched by a second etching liquid.

10. The method for manufacturing the liquid ejecting head according to claim 7, further comprising a step of forming the first metal layer as at least a part of one or more partition walls of the multiple liquid paths.

11. The method for manufacturing method the liquid ejecting head according to claim 7, further comprising:

forming the first metal layer in the vibration unit as at least a part of one or more partition walls of the multiple liquid paths;

forming the second metal layer into one or more corresponding portions to the partition walls across the resin layer; and forming an area of a planar portion of the partition walls formed of the first layer larger than an area of a planar portion of the corresponding portions formed of the second layer.

12. The method for manufacturing the liquid ejecting head according to claim 7, further comprising a step of forming the second metal layer as at least a part of one or more partition walls of the multiple liquid paths.

13. The method of manufacturing method the liquid ejecting head according to claim 7, further comprising the steps of:

forming the second metal layer in the vibration unit as at least a part of one or more partition walls of the multiple liquid paths;

forming the first metal layer into one or more corresponding portions to the partition walls across the resin layer; and forming an area of a planar portion of one or more corresponding portions formed of the second layer larger than an area of a planar portion of the partition walls formed of the first layer.

* * * * *